United States Patent [19]

Huang et al.

[11] Patent Number: 4,743,315

[45] Date of Patent: May 10, 1988

[54] $Ni_3Al$ ALLOY OF IMPROVED DUCTILITY BASED ON IRON SUBSTITUENT

[75] Inventors: Shyh-Chin Huang, Latham; Keh-Minn Chang; Alan I. Taub, both of Schenectady, all of N.Y.

[73] Assignee: General Electric Company, Schenectady, N.Y.

[21] Appl. No.: 901,852

[22] Filed: Aug. 29, 1986

Related U.S. Application Data

[63] Continuation-in-part of Ser. No. 647,328, Sep. 4, 1984, abandoned.

[51] Int. Cl.[4] ..... C22C 19/03

[52] U.S. Cl. ..... 148/429; 420/459

[58] Field of Search ..... 420/459, 460; 148/426, 148/429

[56] References Cited

U.S. PATENT DOCUMENTS

| | | | |
|---|---|---|---|
| 3,021,211 | 2/1962 | Flinn | 148/429 |
| 4,054,469 | 10/1977 | Jackson | 148/31 |
| 4,359,352 | 11/1982 | Ray et al. | 148/31 |
| 4,478,791 | 10/1984 | Huang et al. | 420/590 |

FOREIGN PATENT DOCUMENTS

| | | | |
|---|---|---|---|
| 2037322 | 7/1980 | United Kingdom | 420/460 |

OTHER PUBLICATIONS

Liu, C. T., White, C. L., Koch, C. C., and Lee, E. H., "Preparation of Ductile Nickel Aluminides for High Temperature Use", Proc. Electrochemical Soc. on High Temp. Mat., ed. M. Cubicciotti, 83-7, Electrochem. Soc. Inc. (1983) p. 32.

Lui, C. T. and Koch, C. C., "Development of Ductile Polycrystalline $Ni_3Al$ for High-Temperature Applications", Technical Aspects of Critical Materials use by the Steel Industry, IIB (1983) pp. 42-1-42-19.

*Primary Examiner*—R. Dean

*Attorney, Agent, or Firm*—Paul E. Rochford; James C. Davis, Jr.; Paul R. Webb, II

[57] ABSTRACT

A melt is provided having the formula $$(Ni_{1-x}Al_x)_{99-y}Fe_yB_1$$

The melt is rapidly solidified as ribbon and the ribbon is annealed at about 100° C. Desirable properties are found when x is between 0.21 and 0.26 and y is between 5 and 15.

7 Claims, 2 Drawing Sheets

$NI_3AL$ ALLOY OF IMPROVED DUCTILITY BASED ON IRON SUBSTITUENT

CROSS REFERENCE TO RELATED APPLICATION

The specification is a continuation-in-part of application Ser. No. 647,328, filed Sept. 4, 1984, abandoned.

BACKGROUND OF THE INVENTION

The present invention relates generally to compositions having a nickel aluminide base for use in high temperature applications. More specifically, it relates to a rapidly solidified tri-nickel aluminide which has improved ductility based on a partial substitution of iron for nickel and for aluminum in the base alloy.

It is known that polycrystalline tri-nickel aluminide castings exhibit properties of extreme brittleness, low strength and poor ductility at room temperature. It is also known that the rapidly solidified tri-nickel aluminide alloy in the absence of low concentration of boron also exhibits similar properties at room temperature.

The single crystal tri-nickel aluminide in certain orientations does display a favorable combination of properties at room temperature including significant ductility. However, the polycrystalline material which is conventionally formed by known processes, including rapid solidification processing, does not display the desirable properties of the single crystal material and although potentially useful as a high temperature structural material, has not found extensive use in this application because of the poor properties of the material at room temperature.

For example, it is known that nickel aluminide has good physical properties at temperatures above 1000° F. and could be employed, for example, in jet engines as component parts for use at operating or higher temperatures. However, if the material does not have favorable properties at room temperature and below, the part formed of the aluminide may break when subjected to stress at the lower temperatures at which the part would be maintained prior to starting the engine and prior to operating the engine at the higher temperatures.

Alloys having a tri-nickel aluminide base are among the group of alloys known as heat-resisting alloys or superalloys. These alloys are intended for very high temperature service where relatively high stresses (tensile, thermal, vibratory and shock) are encountered and where oxidation resistance is frequently required. The nickel aluminide has favorable strength-to-weight ratios for use in aircraft at elevated temperatures and various efforts have been made to improve the lack of ductility at lower temperatures.

Accordingly, what has been sought in the field of superalloys is an alloy composition which displays favorable stress resistant properties not only at the elevated temperatures at which it may be used as, for example, in a jet engine but also a practical, desirable and useful set of properties at the lower temperatures to which the engine is subjected in storage and in mounting and starting operations. For example, it is well known that an engine may be subjected to severe subfreezing temperatures while standing on an airfield or runway prior to starting the engine.

Significant efforts have been made toward producing a tri-nickel aluminide and similar superalloys which may be useful over a wide range of temperatures and which are adapted to withstand the stress to which the articles made from the material may be subjected to normal operations over such a wide range of temperatures. Some such efforts have been successful. For example, U.S. Pat. No. 4,478,791 assigned to the same assignee, as the subject application teaches a method by which a significant measure of ductility can be imparted to a tri-nickel aluminide base metal at room temperature to overcome the brittleness of this material.

Also, copending application of the same inventors of the subject application, Ser. No. 647,327, filed Sept. 4, 1984 teaches a method by which the composition and methods of the U.S. Pat. No. 4,478,791 may be improved.

The subject application presents a method and composition for incorporating improvements in the properties of a tri-nickel aluminide over the composition of U.S. Pat. No. 4,478,791.

BRIEF SUMMARY OF THE INVENTION

It is according to one object of the present invention to provide a method of forming a nickel aluminide base article adapted for use in structural parts over a very broad range of temperatures.

Another object is to provide a nickel aluminide base article suitable for withstanding significant degrees of stress and for providing appreciable ductility over the broad range of temperatures.

Another object is to provide a consolidated nickel aluminide material which can be formed into useful parts having a desirable combination of properties of significant strength and ductility over a broad range of temperatures.

Another object is to provide a consolidated material which is suitable for cold rolling, extrusion and isothermal forming.

Another object is to provide a nickel aluminide base material having significantly improved ductility at the lower temperatures at which nickel aluminide is known to have low ductility.

Other objects will be in part apparent and in part pointed out in the description which follows.

In one of its broader aspects, objects of the invention can be achieved by providing a melt of a nickel aluminide containing a boron additive and also containing an iron substituent which substitutes in part for the nickel of the nickel aluminide and also substitutes in part for the aluminum of the nickel aluminide. The melt is rapidly solidified into powder or ribbon by conventional means and can then be consolidated into a useful article.

$$(Ni_{1-x}Al_x)_{89}Fe_{10}B_1.$$

The subscripts for the $(Ni_{1-x}Al_x)$ for the iron and for the boron are given in atomic percent.

Figure 2:
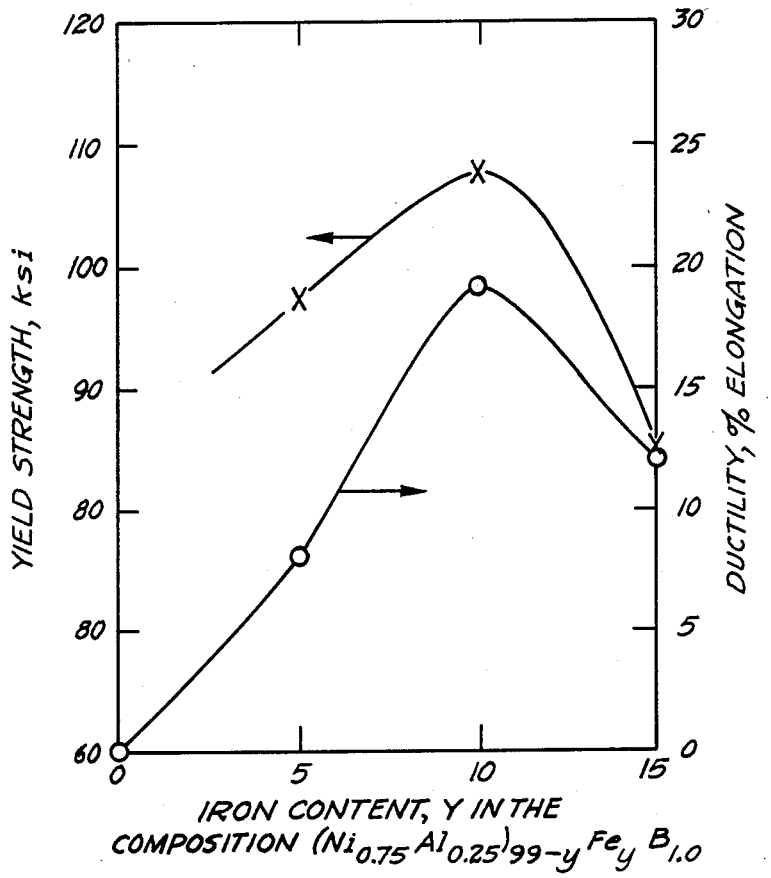

FIG. 2 is a graph of yield strength versus iron content and demonstrating exceptional strength at iron values between 5 and 15 in the above expression. In this figure the iron content is the y of the following expression:

$$(Ni_{0.75}Al_{0.25})_{99-y}Fe_yB_{1.0}.$$

Figure 1:
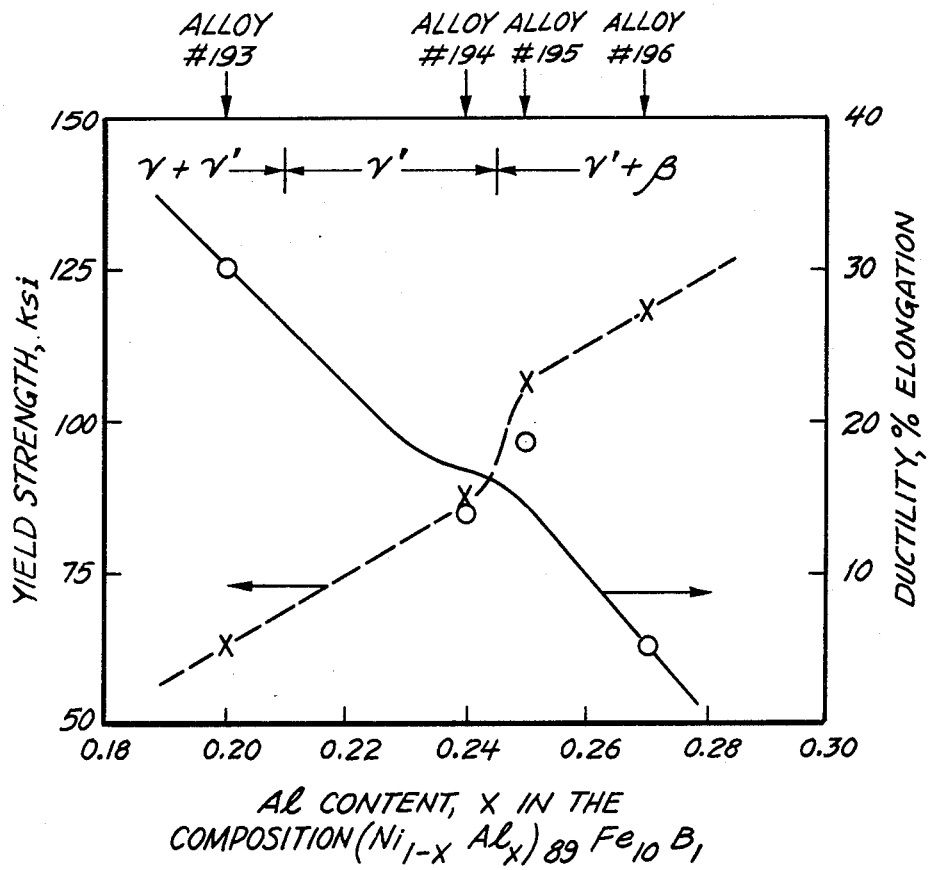
FIG. 1 is a graph showing the yield strength plotted as the left ordinate and ductility in percent elongation plotted as the right ordinate against the aluminum content plotted as the abscissa in percent. In this figure, the aluminum content is the x of the following equation.

The ordinates are essentially the same as in FIG. 1.

DETAILED DESCRIPTION OF THE INVENTION

In their studies of the Ni-Fe-Al ternary system, A. J. Bradley (Journal of Iron and Steel Institute, September 1949, pages 19–30) and V. G. Rivlin and G. V. Raynor (International Metal Reviews, Vol. 79, 1980, pages 79–93) showed that iron substitutes for both nickel and aluminum in the ternary system. However, there is no hint or speculation regarding any of the properties or performance characteristics of any of the materials reported in the article. Also, there was no reference whatever to boron doping or to rapid solidification of any of the compositions which were reported.

More recently, C. T. Liu et al. reported that "the strength of $Ni_3Al$ can be substantially increased by solid-solution hardening with 10 to 15 atomic percent iron". However, Liu makes no reference whatever to the ductility of the iron modified aluminide. Also, Liu did not use and did not suggest use or usefulness of rapid solidification in connection with the aluminide or with the iron modified aluminide. This Liu article appeared in the Proceedings of the Electrochemical Society on High temperature Materials edited by M. Cubicciotti, Vol. 83-7, Electrochemical Society Inc., 1983, page 32. As shown in FIG. 6 of this Electrochemical Society publication, room temperature yield strength was reported at about 500 MPa for an alloy labelled as $Ni_3Al+Fe+$dopants. This compared with a room temperature yield strength of about 300 MPa for an alloy labeled as $Ni_3Al+B$ at a boron concentration of about 0.05% in weight (~0.25% in atom). No ductility behavior of the iron-containing alloy was reported. To change the MPa weights to psi, or to ksi, the following formula is employed:

$$7\ \text{MPa}=100\ \text{psi}=1\ \text{ksi}$$

EXAMPLE 1

An alloy identified as Alloy 115 was prepared to contain 10 atomic percent of iron according to the formula $(Ni_{0.65}Fe_{0.10}Al_{0.25})_{99}B_1$.

It was found that the iron addition resulted in an as-cast ribbon bend ductility of 0.9. A value of 1.0 for the ribbon bend ductility test is a measure of full bending without fracture and this degree of bending is exhibited by base alloy of $(Ni_{0.75}Al_{0.25})_{99}B_1$ when prepared as rapidly solidified ribbon according to the teachings of copending application Ser. No. 444,932, filed Nov. 29, 1982. As taught in the copending application, conventional rapid solidification processing may be employed. This application is incorporated herein by reference.

This value of 0.9 is not acceptable as estabishing that a material is a ductile material. Ductility is measured as the % of elongation which a material will undergo under certain test conditions. Experience in testing such materials has shown that a tensile test of a material having a ribbon bend ductility test result of less than 1.0 inevitably results in an elongation measurement of zero.

The microstructure of the iron modified alloy of tri-nickel aluminide showed evidence of second phase formation.

The material was subjected to heat treatment at 1100° C. for two hours. A ribbon bend ductility test was then performed and it was found that the value determined was not better than the 0.9 value originally obtained as set forth above.

While we do not wish to be bound by the accuracy of the explanation given here, it is offered with the thought that it may assist those seeking to practice this invention.

The composition containing 10 atomic percent iron was made with the expectation that the iron would substitute entirely for nickel of the aluminide. However, it was learned that the iron did not substitute as expected by rather substituted partly for the nickel and partly for aluminum.

The original formula used in forming the melt and ribbon was $(Ni_{0.65}Fe_{0.10}Al_{0.25})_{99}B_1$. In this formula the quantity of iron added was exactly equal to the quantity of nickel omitted.

Accordingly, the original formula was changed to delete only part of the nickel when the iron was added. However, a part of the aluminum was also deleted. The amount of nickel and aluminum deleted was equivalent in atomic percent to the atomic percent of iron added.

This was done in the following examples.

EXAMPLES 2–5

Four compositions, one for each of the four examples, 2–5 were prepared in this study. The formula of the prepared alloy compositions is as follows:

$$(Ni_{1-x}Al_x)_{89}Fe_{10}B_1.$$

The alloys identified by numbers Alloys 193 through Alloys 196 contained varying percentages, x, of aluminum as follows:

TABLE I

| Example | Alloy No. | Percentages of Aluminum |
|---|---|---|
| 2 | 193 | 20% |
| 3 | 194 | 24% |
| 4 | 195 | 25% |
| 5 | 196 | 27% |

Alloys of the respective compositions were prepared and the alloys were melt spun by conventional practice into rapidly solidified ribbons in a vacuum.

A bend test was performed on each ribbon product and a value of 1.0 was obtained for all samples tested.

The respective batches of ribbon for each example was annealed at 1100° C. for 2 hours. The annealing at 1100° C. for 2 hours is a test of whether the ribbons could withstand the annealing which is incident to being consolidated by high temperature isostatic pressing or other conventional consolidation techniques. The batches of ribbon of these examples were annealed at 1100° C. but were not isostatically or other wise pressed.

The microstructure of the respective samples were studied by metallography or electron microscopy and their properties were determined by tensile tests at room temperature. The results of the tensile tests at room temperature are given in FIG. 1.

Also, as shown in this figure, Alloy 193 for Example 2 exhibited two phases, the first being nickel rich solid solution $\gamma$ phase and the second being the $Ni_3Al$ type $\gamma'$ phase. This alloy exhibited good ductility but insufficient strength.

Alloy 196, for Example 5 also exhibited two phases, one being a $Ni_3Al$ type $\gamma'$ phase and the second being a NiAl type $\beta$ phase in substantial proportion. This alloy exhibited good strength but insufficient ductility.

However, Alloy 194 for Example 3 was found to be essentially a highly desirable single phase $\gamma'$ material. This alloy had a desirable combination of strength and ductility.

Alloy 195 also contains $\gamma'$ and $\beta$ phases where the proportion of $\beta$ phase is relatively low. This alloy also was found to have a very favorable combination of ductility and strength.

The yield strength of the annealed Alloy 194 was found to be about 87 ksi or about 610 MPa.

The compositions having a desirable combination of ductility and strength had an aluminum content x between 0.21 and 0.26 in the expression $$(Ni_{1-x}Al_x)_{89}Fe_{10}B_1.$$

A preferred set of properties exist in alloys having an aluminum content x between 0.23 and 0.25 in the same expression.

More importantly, and surprisingly, this Alloy 194 of Example 3 was found to have a ductility of about 14% elongation in the annealed condition.

As is evident from the figure, Alloy 194 has a highly desirable combination of yield strength and ductility at and near the region where the lines plotted to illustrate the experimental values intersect.

EXAMPLES 6 AND 7

The procedures of the above examples were again followed but with one exception. In these examples the amount of aluminum was kept constant and iron was varied as shown in the following Table II:

TABLE II

| | Concentration | Composition Expression |
|---|---|---|
| Example 6 | 5 | $(Ni_{0.75}Al_{0.25})_{94}Fe_5B_1$ |
| Example 7 | 15 | $(Ni_{0.75}Al_{0.25})_{84}Fe_{15}B_1$ |

When both the aluminum concentration and the iron concentration are varied the expression for the composition is as follows:

$$(Ni_{1-x}Al_x)_{99-y}Fe_yB_1$$

wherein x is the aluminum concentration and y is the iron concentration.

The inventors were quite surprised by the results of the tests which were made and of the results of the tests as plotted on the graphs of the accompanying FIGS. 1 and 2. In part, this was because the inventors had no reason to expect or believe that the unusual results are plotted in FIGS. 1 and 2 could be obtained. Also, the information in the Liu prior art reference as discussed above gave no hint or suggestion that any combination of properties as displayed in FIGS. 1 and 2 would be achievable.

The applicants acknowledge that the improvement made in the compositions and process of the copending application Ser. No. 444,932 is very significant in the development of the tri-nickel aluminide alloys into usable compositions. The rapid solidification and the incorporation of the boron made it possible to achieve a ductility in this material which had not bee achieved previously.

It is, of course, most desirable to be able to consolidate a ribbon-like or powder product which is obtained by the rapid solidification process into a body of material which can be formed into parts useful in various apparatus. In order to consolidate a rapidly solidified material, such pressing and heating is needed. Generally, the more heating and pressing to which the material can be subjected without loss of its good properties, the better and the quicker the consolidation and the better the properties of the consolidated material.

In the subject application, one of the most significant findings was that a nickel aluminide having iron partially substituted for nickel and also partially substituted for aluminum for a total substitution of iron of between 5 to 15 atomic percent can be subjected to heating which is incidental to consolidation with a relatively low loss in the desirable properties of the rapidly solidified material. In the particular case of the material containing 10 atomic percent iron, this material can be subjected to higher temperatures and a longer period of heating without loss of its ductility and strength than the material of the copending application Ser. No. 444,932.

We have found that the ductility which is obtained with reference to the copending application for the material containing the stoichiometric ratio of nickel and aluminum and also containing the ductilizing boron can be obtained with the composition containing iron and further that the high ductility can be retained through heat treatment. In fact, in some cases the ductility is improved during the heat treatment. This is a rather unique finding inasmuch as we have learned that the heat treatment of the composition of the copending application Ser. No. 444,932 does result in a substantial loss of ductility for essentially all compositions disclosed in that application.

What is claimed and sought to be protected by Letters Patent of the United States is as follows:

1. As a composition of matter, a $\gamma'$ nickel aluminide base alloy of the following composition $$(Ni_{1-x}Al_x)_{99-y}Fe_yB_1)$$

wherein x of the above formula is between 0.21 and 0.26 and wherein y in the above formula is between 5 and 15, said aluminide being rapidly solidified and having an $L1_2$ type crystal structure.

2. The composition of claim 1 in which x is 0.23 to 0.25.

3. The method of preparing a $\gamma'$ phase iron substituted tri-nickel aluminide base alloy which comprises preparing a composition as follows:

$$(Ni_{1-x}Al_x)_{99-y}Fe_yB_1$$

wherein x is between 0.21 and 0.26 and y is between 5 and 15, preparing a melt of the composition and rapidly solidifying the melt.

4. The method of claim 3 in which the x is 0.23 to 0.25.

5. The method of claim 3 in which the rapidly solidified material is prepared and is consolidated.

6. The method of claim 3 in which the rapidly solidified composition is consolidated by heating and pressing at 1000° C. for about 2 hours.

7. As a composition of matter, a $\gamma'$ nickel aluminide base alloy of the following composition $$(Ni_{1-x}Al_x)_{89}Fe_{10}B_1)$$

wherein x of the above formula is between 0.21 and 0.26, said aluminide being rapidly solidified and having an $L1_2$ type crystal structure.

* * * * *